United States Patent [19]

Nitsch, Jr.

[11] Patent Number: 5,019,131

[45] Date of Patent: May 28, 1991

[54] REDYEING SUPPRESSED BLEACHED FABRIC

[75] Inventor: James L. Nitsch, Jr., St. Louis, Mo.

[73] Assignee: MMOQ, Ltd., St. Louis, Mo.

[21] Appl. No.: 549,617

[22] Filed: Jul. 9, 1990

[51] Int. Cl.[5] ..... D06P 5/15; D06L 3/00

[52] U.S. Cl. ..... 8/457; 8/101; 8/107; 8/108.1; 8/115; 8/482; 8/543; 8/638; 8/649; 8/650; 8/652; 8/654; 8/657; 8/680; 8/917; 8/918; 8/921; 8/922; 8/924; 8/927; 8/928

[58] Field of Search ..... 8/457, 482, 108.1

[56] References Cited

U.S. PATENT DOCUMENTS

| | | | |
|---|---|---|---|
| 1,481,567 | 1/1924 | Senseney | 8/457 |
| 1,655,973 | 1/1928 | Ross | 8/929 |
| 3,990,839 | 11/1976 | von der Elitz et al. | 8/482 |
| 4,252,530 | 2/1981 | Ribka et al. | 8/457 |
| 4,576,611 | 3/1986 | Pascoe | 8/482 |
| 4,588,409 | 5/1986 | Sercus | 8/403 |
| 4,675,023 | 6/1987 | Hyink | 8/447 |
| 4,881,941 | 11/1989 | Dixon | 8/482 |

*Primary Examiner*—A. Lionel Clingman

*Attorney, Agent, or Firm*—Lackenbach Siegel Marzullo & Aronson

[57] ABSTRACT

A process for redyeing partially bleached fabric or garments to yield sharply-etched multicolored designs comprises the steps of:

(a) dyeing the fabric, or purchasing a commercial garment, with a background first color;

(b) gathering selected areas of the dyed fabric with ligatures to restrict access of further reagents;

(c) bleaching the gathered background dyed to remove the first color from the areas outside the gathered areas; and (d) redyeing the bleached areas with a second color, whereby sharply defined multicolored patterns are formed having from about 0.2 mm to about 2 mm of white gap between each color.

15 Claims, No Drawings

REDYEING SUPPRESSED BLEACHED FABRIC

FIELD OF THE INVENTION

This invention relates to the dyeing of fabrics. More specifically it relates to procuring unique multicolor effects in dyeing fabrics principally for wearing apparel.

BACKGROUND OF THE INVENTION

U.S. Pat. No. 4,881,941 discloses a suppressed dyeing method, wherein a gathered textile is immersed in a non-polar medium containing one dye so that only part of the fabric is dyed, then subsequently another dye from an aqueous medium is applied to at least part of the undyed remaining area.

U.S. Pat. No. 4,588,409 teaches dyeing cellulosic fabrics with a plurality of fiber reactive dyes of the halotriazine type, which have different stability to hypochlorite bleach. After one season of sales of a certain color, the goods may be bleached eliminating the least stable halotriazine dyes but retaining the colors of the more stable dyes in order to yield goods of another color for the next season of fashion.

U.S. Pat. No. 3,990,839 shows a process for shadow dyeing polyester fabrics. Dispersions of insoluble dyes susceptible to alkali may be added to a sizing agent for polyester. When these sizing agents are used for a polyester warp having a cellulosic weft and the fabric then dyed, interesting irregular tone-in-tone effects may be generated by spraying the woven fabric with alkali, with or without gathering. More complicated multitone effects may be generated by using several dyes with different resistance to alkali.

U.S. Pat. No. 3,986,824 teaches a process for irregular dyeing of high fashion blue jeans with a pseudo worn-out effect by first dyeing the entire fabric with a uniform fast dye. Then the surface is dyed or printed with a less stable pigment which is not chemically bound to the fabric as is the first dye. Then the fabric is washed by machine to impart and preserve an irregular worn-looking gray effect to part of the blue. Before the washing step, differentiation at selected areas can be generated by mechanical abrasion, such as rubbing. Cleaning and bleaching steps may also be interspersed to give artificial, differential, fashionable appearance to blue jeans.

U.S. Pat. No. 4,397,650 discloses a process for achieving random or faded dyeing effects on textiles by adding coloring material to a foam either before or after the foam is applied to the textile. When the foam collapses, the colorant penetrates the textile in an irregular fashion. The textile is then dried and cured or otherwise fixed.

U.S. Pat. No. 4,187,592 teaches a process for applying geometric and ridged or other irregular dye patterns to fabric by smocking the textile by gathering it to form ridges, moistening with a dye-diffusion agent such as urea solution, applying dye to the exposed portions, hardening to stiffen the ridges, applying concentrated dye to the ridges and outlining the ridges, drying, releasing the gathered portions, and flattening. Three or more darker and darker colors may be employed without drying in-between, so that an overlapped, blended effect is achieved. The ridges may be hand painted.

U.S. Pat. No. 4,000,964 shows a process for modifying the appearance of unfixed dyes with an eluant. The eluant may be colorless in which case an area or streak of a faded color will be formed. Alternatively, the eluant may contain a dye or another color than that of the first unfixed dye, or the original dye may contain two or more colors with different fixing properties. Furthermore, a fabric may be covered with a glass plate having apertures and the eluant applied only at the pattern of apertures. A fabric may be folded and eluant applied to the folds or corners only. Either the dye or the eluant may be applied by rotatable discs which dip into containers of either or both.

U.S. Pat. No. 3,960,477 discloses a process for making cross-dyed fabrics of different colors, especially of cotton. Normal cotton and treated dye-resist cotton are woven in a pattern and dyed with a first color. The dye resist is then chemically removed and the entire fabric redyed another color. Thus, a pattern of the second color and an added effect of both colors is produced.

U.S. Pat. No. 1,655,973 discloses a method for arriving at multicolored diffuse dyeing patterns by twisting wet plush at selected points to wring out the water and create wrinkles. Then the twisted points individually are placed in dye solutions of different colors. Then the entire fabric is preferably dyed with yet another color to blend the early restricted area colors to give a sunburst effect.

U.S. Pat. No. 917,298 describes a process for achieving designs on wet mercerized cotton by differential pressure such as embossing or impressing.

OBJECTS OF THE INVENTION

It is an object of the invention to produce multicolored dyed fabrics with a random customized effect.

It is a further object of the present invention to produce multicolored dyed fabrics characterized by areas of separate colors which are not overlapped to produce an unwanted third superimposed color.

It is yet another object of the invention to produce a multicolored dyed fabric having sharp delineation between the colors, or even a gap of about 0.2 mm to 2 mm between the different colors.

Another object of the invention is to achieve multicolored effects employing simple equipment and inexpensive reagents.

Other objects will be apparent to those skilled in the art.

SUMMARY OF THE INVENTION

Surprisingly, the objects of the invention are achieved by a process comprising the steps of:

(a) dyeing a fabric with a background first color;

(b) gathering selected areas of the dyed fabric to restrict access of further reagents;

(c) bleaching the gathered dyed fabric to remove the first background color from the areas outside the gathered areas; and (d) redyeing the bleached areas with a second color.

Normally, there are rinsing steps before and after each of the dyeing and bleaching steps. The process may be repeated to yield a plurality of colors.

When carried out properly, this process is unique in that the multidyed fabric shows sharp delineation between the colors even a narrow gap of bleached white of about 0.2 to about 2 mm. The various processes of the prior art based on diffusion, elution, superimposed dyeing, differential dye-resistance and the like yield superimposed, blended designs, which do not have the novel high style of the products of the present invention.

The preferred fabric is cotton; the preferred bleach is dilute hypochlorite, and the preferred redyes are fiber-reactive dyes of the halotriazine type.

DESCRIPTION OF THE PREFERRED EMBODIMENTS

The fabric forming the substrate for the process of the present invention may be made from vegetable fibers such as cotton, or regenerated cotton, that is rayon; bast fibers such as jute, flax, hemp, ramie, sunn, benaf, urena, and nettle animal fibers such as wool or silk. Synthetic fibers such as acrylic, polyamide, polyester, polyvinyl chloride, polyvinyl alcohol, elastomers, and polyolefins such as polypropylene may also be employed. Blends of various fibers and chemical modifications, such as cellulose acetate and triacetate, may also be used. Although any fiber or blend may be used, it must be coordinated with the appropriate type of dye.

As is well-known to those skilled in the art, different classes of dyes are used for different textiles with different chemical structure. There are acid dyes, basic dyes, mordant dyes, direct dyes, ingrain dyes, disperse dyes and pigments, vat dyes, sulfur dyes, and fiber-reactive dyes. For the bleaching and redyeing steps, a preferred combination is cotton and fiber-reactive dyes.

There are numerous weaves and styles of weaving. A heavy-ribbed weave suitable for sport clothes for both men and women is one weave suitable for the present invention, but any type of weave of any type of fabric with any type of dye may be employed. Denim, muslin, and chambray are preferred.

Based on aesthetic, if not technical reasons, it is often preferred to dye the original background color of the fabric a darker hue than succeeding colors. A dark blue, a black, or a purple are preferred, but any color is operational. The original dyeing of the background color is conventional. It is reasonable and proper for the practitioner of this invention to buy or obtain dyed goods through normal commercial channels to satisfy the original dyed step.

For control of the procedure of the present invention, it is preferred to rinse and maintain the background-dyed fabric in a wet state before the bleaching step. Also, since the bleaching step is best carried out at an elevated temperature, it is preferred that this pre-rinse be carried out in clean water at a temperature from about 30° C. to about 55° C., although from 20° C., or even 15° C. to about 70° C. is operational. High temperatures before and during the bleaching step may weaken the fabric as well as bleach it.

After wetting/rinsing the fabric, it is gathered according to the aesthetic plan of the practitioner. By gathering, it is understood that the material is folded, wadded, twisted, knotted, wrinkled, bunched up, tied off or otherwise manipulated so that the bleach comes in contact with only selected areas of the dyed fabric as chosen by the practitioner. For example, if the material is wadded into a ball, only an outside part thereof will be exposed to bleaching. Rubber bands, common household string, hemp string, cotton string, nylon string, metallic wire such as aluminum, copper, or steel, shoe laces or other fabric bands of cotton or nylon or other material are the preferred ligatures for gathering, but any mode including clothes pins may be used.

The bleaching step has several parameters each with a wide range of choices within which the process of the present invention is operative. Some of the parameters are the choice of bleach, the concentration of bleach, the duration of bleaching, and the temperature of bleaching.

The bleaching agent may be an inorganic or organic oxidizing agent. Hypochlorite, hydrogen peroxide, and perborate are preferred, yet hypobromite, hypoiodite, permanganate, dichromate, ozone, or any other oxidizing agent may be employed. Interesting color effects may be achieved by using colored oxidizing agents such as solutions of potassium permanganate or sodium dichromate. Commercial household bleach, 5.25% concentration of sodium hypochlorite, is preferred.

The concentration of bleach used relates to the temperature of the bleaching step, the duration of the bleaching step, and the type, composition, weave, and strength of the fabric used. Hypohalites are preferably used at 1 to 8 wgt % concentration. Hydrogen peroxide may be employed at 0.5 to 2 wgt % concentration. Sodium perborate is preferably used at 2 to 8 wgt % concentration. The preferred bleach is a 2.5 wgt % solution of sodium hypochlorite.

The duration of the bleaching step may vary from a few minutes to several hours depending on the strength of the bleaching agent, the type of fabric, and the temperature of the bleaching bath. The preferred time is from one-quarter to two and one-half hours. That time period is satisfactory for a medium-weight denim, employing 2.5 wgt % sodium hypochlorite at 50°-55° C. The preferred temperature range for bleaching is from 40° C. to 70° C.

After the non-gathered areas of the substrate fabric have been bleached to the shade of white or paleness of tint desired, the bleaching action is stopped by rinsing the gathered, partially bleached fabric in clean water, preferably at ambient temperature for about five minutes or more.

After the background-dyed, gathered fabric has been bleached, it is redyed with another color in the non-gathered areas. For wool fabrics, acid, basic, mordant, fiber reactive, and vat redyes may be used. For wool/cotton or wool/rayon blends, acid, direct, mordant, and fiber reactive dyes are suitable. For silk fabrics, acid, basic, direct, and mordant dyes are preferred for dyeing and redyeing. For cotton fabrics, including denim, muslim, and chambray, azoic, basic, direct, mordant, oxidative, fiber reactive, sulfur, and vat dyes are employed. For the bast fibers (linen, flax, hemp, jute, ramie, etc.) acid, direct, fiber reactive, vat, and solubilized vat dyes are suitable.

In polyamide fibers such as nylon—6, nylon 6—6, and nylon 6—10, acid, disperse, mordant, pigment, and fiber reactive dyes are preferred for both background dyeing and selected redyeing. Disperse and pigment dyes are employed for polyester fabrics. For acrylic fibers such as Creslan®, Acrilan®, Orlon®, and Courtelle®, basic disperse, and pigment dyes are best employed. Disperse colors are used for polyolefin fabrics. Basic and disperse colors are used for polyvinyl chloride fabrics. Rubbery fabrics such as Lycra®, may be dyed with acid, disperse, fiber reactive, and vat dyes. Interesting stylish effects can be generated with the process of the present invention for such fashion, elastomeric garments as women's swim wear.

Fiber-reactive dyes are preferred for those categories of fabric with which they can be used, as listed above, because they react with the substrate to form covalent chemical bonds, rather than dyeing by mere secondary forces or occlusion. Within the category of fiber-reactive dyes there are at least four classes. All four are available from PRO Chemical & Dye Inc., Somerset, Mass. 02726, a distributor. The MX series (ICI, Wilmington, Del.) is the most reactive and most versatile, comes in 43 colors, but has the shortest shelf life. These dyes set even at ambient temperature. The F series is slightly less reactive but has four times the shelf life. Higher dyeing temperatures of 41°-43° C. are recommended. The F series is from Chemische Industri, Basel (CIBA). Liquid reactive dyes from Carbic Hoechst (Frankfurt) are used best at 60° C. and are best set by steaming. The H series are available as both powder and liquids especially for printing and painting on natural fibers, such as cotton, wool, and silk. The redyeing is done at 80° C. followed by steam setting at room temperature. For the process of the present invention, use of the MX series is preferred, especially colors such as PROCION ® MX-5B Red 308 (CI Red 2), and MX-8G Yellow 108 (CI 86). A good original background dye is PRO cotton black 602 powder.

It is advantageous to fix the redye step with a fixative or activator solution of a salt such as sodium chloride, sodium hydroxide, trisodium phosphate, or sodium carbonate. Of these salts, sodium carbonate is preferred (PRO dye activator).

After redyeing, the fabric is rinsed and then washed with a cleansing solution of nonionic/cationic detergent, such as PRO Co's Synthrapol SP TM (ICI).

After washing, the gathering ligatures are removed and the entire fabric is rinsed once more. At this point, the entire gathering, bleaching, redyeing process may be repeated to add a third color in other selected areas, and after that, if desired, the process of the present invention could be repeated to add yet a fourth or even fifth or more color.

The product of the present invention differs from different but competitive processes in the sharp delineation between the various colored areas caused by the unique dyeing/gathering/bleaching/redyeing/regathering/rebleaching/redyeing steps of the present invention. Not only are there no muddying, blending, or superposition of colors to yield intermediate colors, but usually there is a sharp etched appearance in the designs generated by gaps of about 0.2 mm to about 2 mm of bleached undyed whiteness between the various colors. Without restricting the scope of the present disclosure by hypothesis, which may or may not be scientifically valid, it is believed that this sharp etched effect is due to the fact that the bleaching molecules, such as hypochlorite anion, or peroxide, or "atomic oxygen", are smaller entities than the large multiring, aromatic dye molecules. Hence, when the gathered fabric is bleached, the small oxidizing moieties can diffuse a little bit farther into the restricted, gathered fabric during the bleaching step than can the large redyeing molecules into the same restricted areas during the redyeing step. Thus, when the fabric is rinsed, ungathered, and washed, a unique etched effect with sharp delineation of colors is achieved. The various processes of the prior art do not have the same succession of steps, hence do not achieve this novel result.

The disclosure above has described some of the parameters in carrying out the process of the present invention. Without departing from the spirit and scope of this invention, these parameters may be changed. The following Examples illustrate without limiting the scope of the present invention.

EXAMPLE 1

A commercially made and dyed royal blue denim jacket weighing 1809 g. is prescoured in a 2% solution of mixed nonionic sulfosuccinate anionic detergent at 30° C. for eight minutes and then rinsed in cold water.

While still wet it is gathered by hand clumping into a highly creased ball and held by six large rubber bands into this ball shape. The gathered washed, wet jacket is then placed in 8 liters of 3% sodium hypochlorite for 1½ hours at 50° C. and then rinsed in ambient water for 15 minutes still gathered.

A redyeing bath is made from a concentrate of 20 g. PROcion MX-202 strong orange fiber reactive dye and 30 g. urea in 400 ml water at about 70° C., which after dissolution is added to 8 liters of water containing 250 g. of sodium carbonate at 30° C. The gathered, partially bleached jacket is redyed for one hour, rinsed at ambient temperature, ungathered by releasing the ligatures, and then washed at 60° C. with 2% nonionic/sulfosuccinate anionic detergent, rinsed, dried, and ironed.

A unique, sharply etched orange/blue design results with about 0.5 mm of white between the orange and blue areas.

EXAMPLE 2

A yard-square piece of 14-oz. commercial denim weighing 300 g. as used in mens' blue jeans has been commercially dyed indigo blue with that dye. A plurality of rubber bands are then used randomly to gather about 70% of the fabric. The gathered piece is first rinsed and while wet placed in a tub of 2.5 wgt % sodium hypochlorite bleach solution at 55° C. for 80 minutes. The gathered, bleached section is then rinsed in running water for about ten minutes.

In another tub, a conventional fiber reactive dye solution of PROcion MX Orange 202 at a concentration of three grams per liter also containing 5. grams per liter of sodium carbonate is prepared and held at 30° C. The gathered, bleached, rinsed fabric is then orange-dyed in this solution for 50 minutes, taken out and rinsed in 40° C. water for 10 minutes, ungathered, scrubbed in 2% nonionic detergent for 15 minutes, and then dried.

A brilliant etched, randomly patterned, orange/blue design on the denim results. This product is suitable for making into garments such as denim jackets.

EXAMPLE 3

A woman's, white cotton blouse is prescoured in a 2% solution of a nonionic detergent at 30° C. for five minutes and rinsed in cool water.

Then a dye bath is made from a concentrate of 25 g. PROcion MX-511 fiber reactive chocolate brown and 30 g. of urea in 350 ml of water at about 70° C., which, after dissolution, is added to 10 liters of water containing 250 g. of sodium chloride at 30° C. The prescoured, wet blouse is background dyed for 45 minutes, rinsed at 25° C., and then washed at 65° C. in water containing 2% nonionic detergent, and then rinsed again.

At a plurality of arbitrary random points, areas of the blouse are gathered into wadded balls, held by rubber bands, and then the blouse while still wet and gathered, is placed in 6 liters of 3% sodium hypochlorite for 90 minutes at 45° C. The gathered, partially bleached blouse is then rinsed in ambient water for ten minutes.

A redyeing bath is made from a concentrate of 20 g. PROcion MX-202 strong orange fiber reactive dye and 25 g. urea in 350 ml of water at about 70° C., which, after dissolution, is added to 8 liters of water containing 200 g. of sodium carbonate at 30° C. The gathered, bleached blouse is redyed for one hour, rinsed at 25° C., ungathered, and then washed at 60° C. with water containing 2% nonionic detergent, rinsed, dried, and ironed.

A uniquely, sharply etched orange/brown design on the blouse results with about 0.3 mm of white between the orange and chocolate colored areas.

EXAMPLE 4

A man's commercially dyed, finished 50% cotton/50% polyester dark gray trousers with 36-inch waist and 29-inch inseam weighing 825 g. is prescoured in a 2% nonionic detergent at 35° C. for ten minutes and then rinsed in cool water.

The wet trousers are gathered into a wadded ball, held by rubber bands, and then placed in 8 liters of 2.5% sodium hypochlorite for two hours at 40° C. The gathered, partially bleached trousers are then rinsed at ambient temperature for 15 minutes.

A redyeing bath is made from a concentrate of 40 g. PROcion MX-300 scarlet fiber reactive dye and 50 g. urea in 350 ml water at about 70° C., which after solution is added to 10 liters of water containing 800 g. sodium chloride at 35° C. The gathered, bleached trousers are redyed for 90 minutes, rinsed at 30° C., ungathered, and then washed at 60° C. with water containing 2% nonionic detergent, rinsed, dried, and ironed.

A sharply etched scarlet/dark gray design on the trousers results with about 0.2 mm of white between the scarlet and dark gray areas.

The above Examples illustrate without limiting the scope of this disclosure. Numerous other variations may be conceived and carried out without departing from the spirit and scope of the present invention which is described by the following claims for which Letters Patent are sought.

I claim:

1. A process for the redyeing of partially bleaching agent fabric to yield multicolored designs comprising the steps of:

(a) dyeing the fabric with a background first color;

(b) gathering selected areas of the dyed fabric to restrict access of further reagents;

(c) bleaching the gathered dyed fabric to remove the first color from the area outside the gathered areas; and (d) redyeing the bleached areas with a second color.

2. A process as in claim 1, wherein a rinsing step is inserted after dyeing step (a).

3. A process as in claim 1, wherein a rinsing step is inserted after bleaching step (c).

4. A process as in claim 1, wherein a rinsing step is inserted after redyeing step (d).

5. A process as in claim 1, wherein gathering step (b), bleaching step (c), and redyeing step (d) are repeated at least once each in order to provide a multiplicity of colors.

6. A process as in claim 1, wherein the dye for redyeing step (d) is selected from the group consisting of azoic, basic, direct, mordant, oxidation, fiber reactive, sulfur, vat dyes, and mixtures thereof.

7. A process as in claim 6, wherein the dye is a fiber reactive dye.

8. A process as in claim 1, wherein the bleach is selected from the group consisting of hypochlorite, hydrogen peroxide, perborate, dichromate, permanganate, organic peroxide, and mixtures thereof.

9. A process as in claim 8, wherein the bleaching agent is sodium hypochlorite.

10. A process as in claim 1, wherein the gathering is accomplished by tying off areas with a ligature selected from the group consisting of rubber bands, hemp string, cotton string, nylon string, metallic wire, fabric bands, and mixtures thereof.

11. A process as in claim 1, wherein the bleaching step is carried out for from 15 to 150 minutes at a temperature from 40° C. to 70° C.

12. A process as in claim 9, wherein the concentration of sodium hypochlorite is from 1 to 8% by wgt.

13. A process as in claim 1, wherein the fabric is selected from the group consisting of cotton, rayon, cellulose acetate, denim, chambray, muslin, cellulose triacetate, wool, silk, cellulose, linen, polyamides, polyesters, acrylic, polypropylene, and mixtures thereof.

14. A process as in claim 1, wherein the redye hue is lighter than the background dye hue.

15. A process as in claim 1, wherein there is a delineation zone of from 0.2 to 2 mm between the background dye areas and the redye areas.

* * * * *